United States Patent [19]

Bricmont

[11] 4,353,690

[45] Oct. 12, 1982

[54] APPARATUS TO ANCHOR SKIDS FOR A REHEAT FURNACE

[75] Inventor: Francis H. Bricmont, Pittsburgh, Pa.

[73] Assignee: Bricmont & Associates, Inc., McMurray, Pa.

[21] Appl. No.: 282,963

[22] Filed: Jul. 13, 1981

[51] Int. Cl.[3] ..... F27D 3/02; F27D 3/00

[52] U.S. Cl. ..... 432/234; 432/239; 432/245; 432/251

[58] Field of Search ..... 432/234, 251, 239, 245

[56] References Cited

U.S. PATENT DOCUMENTS

| | | | |
|---|---|---|---|
| 1,397,367 | 11/1921 | Costello | 432/234 |
| 2,369,419 | 2/1945 | Strassburger | 432/234 |
| 3,450,394 | 6/1969 | Wilde et al. | 432/234 |

*Primary Examiner*—John J. Camby

*Attorney, Agent, or Firm*—Thomas H. Murray; Clifford A. Poff

[57] ABSTRACT

Skids used to support a workpiece in a reheat furnace are adjustably positioned and anchored to resist longitudinal movement of the skids while workpieces are moved therealong. The anchor apparatus includes a rectangular housing, one end of which is attached by an anchor rod to a foundation while the other end has an aperture to pass an anchor rod into the space between the side walls of the housing. An internal bearing wall subdivides the space in the housing into two cavities. A bearing plate on the movable anchor rod in one cavity is forced by a piston and cylinder assembly to move the rod into the housing to thereby adjust the position of a skid to which it is attached. Shim plates are placed in the second cavity within the housing between an internal wall and a bearing flange attached to the movable anchor rod. Other shim plates are inserted between the end wall of the housing and the actuator to maintain an effective range of adjustment by the actuator.

8 Claims, 3 Drawing Figures

10
11
12
13
15
16
17
18
19
21
22
23
24
25
26
27
28
29
31
32
33
34

III
31
32
33
35
36
37
38
39
41
42
43
46
47
48
55

38
39
41
42
43
44
45
46
47
48
56

APPARATUS TO ANCHOR SKIDS FOR A REHEAT FURNACE

BACKGROUND OF THE INVENTION

This invention relates to a reheat furnace for metallic workpieces, and more particularly to apparatus for anchoring workpiece-support skids to a foundation for resisting longitudinal movement of the skids while workpieces are advanced on the skids through the furnace.

Although not so limited, the present invention is particularly useful for anchoring skid members of a pusher-type reheat furnace used to heat billets, blooms or slabs. The workpieces are advanced through the furnace for heating therein by a pusher mechanism at the charging end or side of the furnace to engage a newly-introduced workpiece. A cold workpiece is pushed into the furnace against a continuous line of workpieces that abut in a side-by-side relation. A heated workpiece is discharged from the opposite end of the furnace in any one of various manners such as sliding on skids by gravity through a door opening onto a roller table or a workpiece-extracting device. A furnace may embody a construction to permit pushing of a heated workpiece through a side-door opening onto a mill table by a suitable mechanism. After heating in the furnace, the workpiece is advanced by a roller table to a rolling mill or other apparatus to process the workpiece.

In a reheat furnace of the above-described type, and in other furnace constructions, each of a plurality of skid members must be anchored against longitudinal movement and supported to carry a workpiece or article while it is advanced through the furnace. The skids must be anchored in a way to resist the forces imparted to the skids due to the sliding motion of the workpieces therealong. Such furnaces are subject to the problem, which is particularly acute in a reheat furnace for slabs, of stretching and loosening up of the skids. Premature failure, due to excessive vibration of the skids, will occur should they become loose. At the same time, maintenance costs become excessive because of the loss of insulation which cannot be retained on the loose skids. Thus, the loss of insulation substantially increases the heat loss and the fuel requirement by the furnace. Usually, the skids which sometimes take the form of pipes for a flow of coolant medium are cooled to prevent overheating. A turnbuckle is sometimes incorporated as part of the anchoring system to adjust the skids. However, in actual practice it is practically impossible to adjust these turnbuckles for tightening the skids after operation of the reheat furnace for a length of time. The turnbuckles must be situated at a site having a particularly hostile environment since they must be located at the entry side of the furnace and usually below machinery of the pusher and roller tables for supplying workpieces to the furnace. The size of the turnbuckle is usually relatively large since in the anchoring system, rod members having a diameter of 3–4 inches must be joined together by the turnbuckle. One rod member extends to the foundation and another rod member extends to the furnace skid. Adjusting and tightening of a turnbuckle for the skid member is usually performed while the skids are heavily loaded due to the weight of the workpieces, thus requiring the development of a substantially large force. In a slab reheat furnace, for example, each skid is typically loaded in excess of 150,000 pounds.

Thus, a turnbuckle is not practical and is usually inoperative for its intended purpose.

SUMMARY OF THE INVENTION

It is an object of the present invention to provide apparatus including an actuator, preferably hydraulically operated to adjust anchoring of a skid to a foundation for resisting longitudinal movement of the skid while workpieces move therealong within a furnace.

More particularly, according to the present invention, there is provided an apparatus to adjustably anchor a workpiece-support skid to a foundation for resisting longitudinal movement of the skid while workpieces move therealong within a furnace. The apparatus includes the combination of a housing having side walls engaged with inner and end bearing plates, rod means each extending from one of the opposite ends of the housing for attachment to the foundation and the skid, one rod member being attached to the housing and the other rod member being longitudinally movable between the side walls of the housing, bearing flanges joined to the longitudinally-movable rod member in the housing to form first and second spacer cavities with the inner and end bearing plates, an actuator means in the first cavity for drawing the movable rod member in the housing, and rigid spacer means for the second cavity to hold the movable rod member in the housing.

According to the preferred aspect of the present invention, the actuator means includes a piston and cylinder assembly for operation in response to a fluid medium delivered under a controlled pressure such as from a hand pump. It is preferred to provide additional spacers to engage with the actuator means in the first cavity for insertion and removal from opposite sides of the actuator for compact design that minimizes the physical size of the apparatus. The inner and end bearing plates of the housing each having an aperture arranged for displacement of the removable rod member in the first and second cavities of the housing. The rigid spacer means for each cavity are preferably shim plates which are retained in the housing by joining a bottom wall to the side walls of the housing whereby the first and second cavities take the form of hollow pockets at each side of the inner bearing plate.

These features and advantages of the present invention as well as others will be more fully understood when the following description of the preferred embodiment is read in light of the accompanying drawings, in which.

Figure 1:
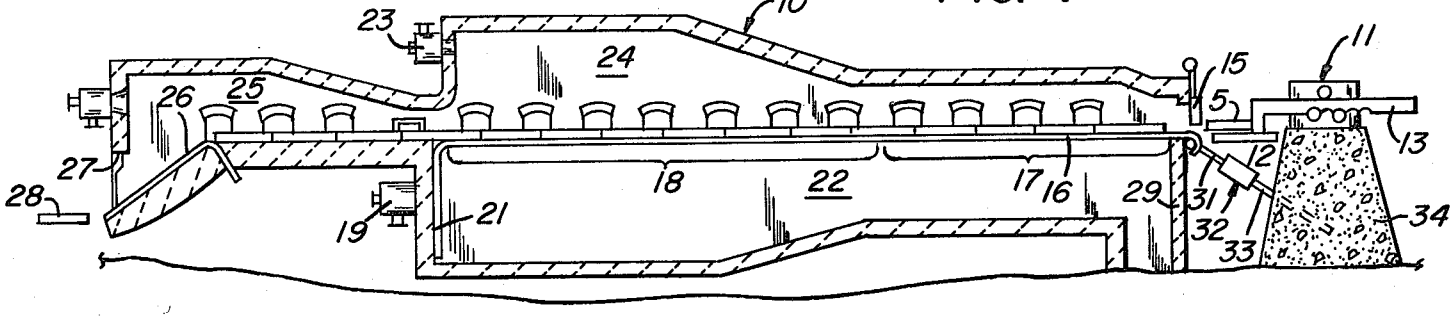
FIG. 1 is an elevational view, in section, to show the anchor apparatus of the present invention for skids in a continuous reheat furnace for slab-like workpieces.

In FIG. 1, reference numeral 10 identifies a continuous slab-type reheat furnace having a slab pusher 11 at the entry side of the furnace to engage with the side of a slab S. A furnace delivery table 12 delivers a succession of slabs to the entry side of the furnace where each slab is pushed by a ram 13 of pusher 11 through a door opening in the furnace. The door opening is normally closed by a door 15. The newly-charged slab abuts against a slab previously introduced into the furnace and thereafter continued movement of the pusher advances the entire load of slabs along the furnace. After a slab is moved from table 12 it is supported, in part, by a plurality of spaced-apart skids 16, only one of which is shown in FIG. 1. The skids, which are of well-known construction, usually include internal ducts for the flow of a coolant medium to prevent overheating. Insulation is usually attached to the skids to prevent an excessive heat loss while at the same time, avoids or at least minimizes the cooling of the slabs at the point of contact with the skids. The slab-type reheat furnace shown in FIG. 1 embodies a construction in which the water-cooled skids extend along a preheat zone 17 and a heating zone 18. A burner 19 opens out of the bottom burner wall 21 to generate a high-temperature environment in a flue space 22 beneath the slabs and a burner 23 communicates with a flue space 24 above the slabs to create a high-temperature environment for heating the slabs from their top surfaces. Beyond the heating zone 18, there is a soaking zone 25 having a refractory hearth which extends from the bottom burner wall 21 to downwardly-inclined skids 26 used to conduct a heated slab from the furnace through a door opening 27 onto a furnace delivery table 28. Other furnace designs provide for the removal of the slab from the soaking zone by mechanical extractor arms which move into a recess below the slab. The slab is lifted by the extractor arms and carried from the furnace to the furnace delivery table.

As illustrated in FIG. 1, the skid 16 extends from a point externally of the furnace along the preheat zone 17, heating zone 18 and downwardly along the bottom burner wall 21 to a point where the terminal end communicates with a conduit for coolant. At the charging side of the furnace, the skid rail extends in a generally-downward direction from furnace end wall 29 where the end of the skid is coupled to one end of an anchor rod 31 having its free end connected to a rectangular housing 32 of an adjustable anchor apparatus embodying the features of the present invention. Extending from the housing 32 is an anchor rod 33 which is embedded for support by a foundation 34 used to support the pusher 11.

Figure 2:
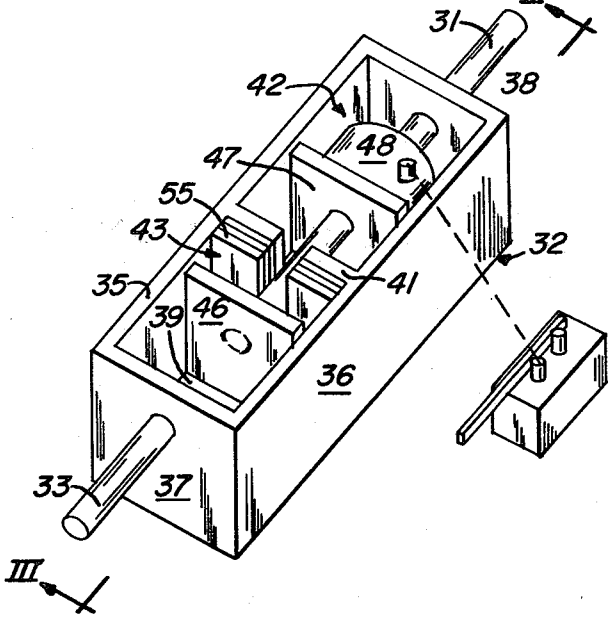
FIG. 2 is an enlarged isometric view of the preferred form of the anchor apparatus according to the present invention.
Figure 3:
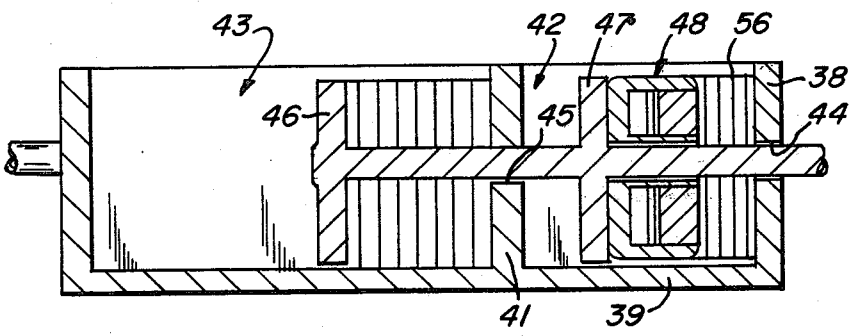
FIG. 3 is a sectional view taken along line III—III of FIG. 2.

As shown in FIGS. 2 and 3, housing 32 includes longitudinal side walls 35 and 36 joined together along one edge by an end wall 37 and opposite thereto by an end bearing plate 38. The housing preferably includes a bottom wall 39. Between end wall 37 and end bearing plate 38 there is an internal bearing wall 41 to subdivide the space enclosed within the housing into a first cavity 42 and a second cavity 43. In the embodiment shown in FIGS. 2 and 3, anchor rod 31 extends through an aperture 44 in bearing wall 38 and thence through a slotted opening or aperture 45 in internal bearing wall 41. The terminal end of anchor rod 31 lies within cavity 43 where it is joined with a bearing flange 46. A bearing flange 47 is joined to anchor rod 31 within cavity 42. Between bearing flange 47 and end bearing plate 38, there is arranged an actuator 48, preferably in the form of a hydraulically-operated piston and cylinder assembly. A suitable hand pump 49 is coupled by a conduit line to the actuator for delivering fluid under pressure to force bearing flange 47 toward the inner bearing plate 41, thereby drawing part of the length of anchor rod 31 into the housing. The force applied to anchor rod 31 tightens the skid member to which it is attached; while anchor rod 33 prevents movement of the housing. After the skid is adjusted for proper anchoring against any stretching or loosening, spacer members 55, preferably in the form of shim plates, are inserted into the gap between bearing plate 46 and inner bearing wall 41. The actuator can then be depressurized. Shim plates 56 are inserted, as necessary, between actuator 48 and end bearing wall 38 to maintain an effective range of adjustment by the actuator. Thereafter, the actuator can again be pressurized and additional shim plates placed between bearing plate 46 and internal bearing wall 41. This process can be repeated until the desired positioning of the skid is attained. A bolt-type fastener is passed through the various shim plates and bearing walls 38 and 41 to retain the plates in the pockets throughout extended periods of furnace operation. It is to be understood that while the foregoing description provides that anchor rod 33 prevents displacement of the housing 32, the housing can be installed for a reverse mode of operation in which anchor 33 is coupled to a skid whereby the actuator moves the skid as well as the housing 32 during the adjustment operation. It is also to be understood that each skid for the furnace is positioned by the use of a separate adjusting housing 32 and its associated component parts.

Although the invention has been shown in connection with a certain specific embodiment, it will be readily apparent to those skilled in the art that various changes in form and arrangement of parts may be made to suit requirements without departing from the spirit and scope of the invention.

What is claimed is:

1. In a reheat furnace for metallic workpieces, apparatus to adjustably anchor a workpiece-support skid to a foundation for resisting longitudinal movement of the skid while workpieces move therealong in the furnace, said apparatus including the combination of:

a housing including side walls engaged with inner and end bearing plates, rod members each extending from one of the opposite ends of said housing for attachment to said foundation and said skid, one rod member being attached to said housing and the other rod member being longitudinally movable in the housing between the side walls thereof, bearing flanges joined to the longitudinally-movable rod member in said housing to form first and second spacer cavities with said inner and end bearing plates, an actuator means in said first cavity for moving the movable rod member in said housing toward the rod member attached thereto, and rigid spacer means for said second cavity to hold the movable rod member in said housing.

2. The apparatus according to claim 1 wherein said actuator means includes a piston and cylinder assembly.

3. The apparatus according to claim 1 or 2 further including a spacer engageable with said actuator means in said first cavity.

4. The apparatus according to claim 1 wherein said inner and end bearing plates each having an aperture to receive said movable rod member for movement in said first and second cavities.

5. The apparatus according to claim 1 wherein said rigid spacer means includes shim plates.

6. The apparatus according to claim 1 further including an anchor plate joined to the side walls of said housing and said one rod member.

7. The apparatus according to claim 6 wherein said housing further includes a bottom wall joined to said side walls to form a hollow pocket at each side of said inner bearing plate defining one of said spacer cavities.

8. The apparatus according to claim 1 wherein the rod member attached to said housing extends for support by said foundation.

* * * * *